United States Patent [19]

Holleman et al.

[11] Patent Number: 4,978,128

[45] Date of Patent: Dec. 18, 1990

[54] BOARD GAME

[76] Inventors: Colleen Holleman; Gregg Holleman, both of 3646 Espanola, Dallas, Tex. 75220

[21] Appl. No.: 411,896

[22] Filed: Sep. 25, 1989

[51] Int. Cl.[5] ..... A63F 3/00
[52] U.S. Cl. ..... 273/248; 273/287
[58] Field of Search ..... 273/249, 248, 287, 285

[56] References Cited

U.S. PATENT DOCUMENTS

| | | | |
|---|---|---|---|
| 1,383,185 | 6/1921 | Boyd | 273/249 |
| 3,148,886 | 9/1964 | Sharp | 273/287 |
| 3,356,369 | 12/1967 | Stubbmann | 273/249 |

FOREIGN PATENT DOCUMENTS

| | | | |
|---|---|---|---|
| 2055299 | 3/1981 | United Kingdom | 273/287 |

OTHER PUBLICATIONS

Parcheesi, Selchow and Righter Co. Catalog, Bayshore, N.Y., p. 7.

*Primary Examiner*—Benjamin Layno
*Attorney, Agent, or Firm*—John B. Dickman, III

[57] ABSTRACT

A game board and game pieces for playing a game of skill and chance, using dice and marbles. The game board has a raised playing surface with peripheral double tracks and cross shaped inner tracks. Troughs are located in the depressions defined by the quadrants between the peripheral double tracks and the cross shaped inner tracks. Each player has his/her own pair of dice and a plurality of playing pieces. A player's playing pieces are divided into four of a first color, e.g. blue, and four of a lighter shade of the same color, e.g. light blue. The player's dice are colored to correspond to his/her playing pieces wherein one die is of the first color, e.g. blue, and other die is of a lighter shade of the same color, e.g. light blue. The playing piece and dice of the other players are of different colors e.g. red and light red, green and light green, etc.

2 Claims, 1 Drawing Sheet

BOARD GAME

BACKGROUND OF THE INVENTION

This invention relates to a game board for playing a game of chance and skill with dice and marbles. The game board has marble receiving holes and dice receiving troughs.

Game boards are well known in the prior art. Further, game boards for playing games of chance and skill using marbles and dice are well known. Two such patents include U.S. Pat. Nos. 3,166,325 and 3,148,886. The basic difference between these patents is the board lay-out, which is critical in playing any board game. The board game in U.S. Pat. No. 3,166,325 is laid out in the shape of a Maltese Cross. U.S. Pat. No. 3,148,886 is laid out in a cross-shape divided into four qradrants with a triangle in each quadrant. While the two cited board games represent the more recent board games played with marbles and dice, there are several older board games which are also played with marbles, and some with marbles and dice. However, there are no game boards which are similar to the present invention.

In general there is shown a game board having a raised playing surface and trough-like depressions in which the dice, providing the chance aspect of the game, may be rolled, restricting their rolling to designated areas.

The playing pieces are differently colored marbles which are moved along a common track with depressions for holding the marbles. Each player moves this marbles around the track to his home base, with the winner determined by the first to finish.

It is an object of this invention to provide a game which is easy to understand and play.

It is a further object of this invention to provide a game which combines chance and skill to hold the players attention.

A still further object is to provide a game board that provides a challenging track and troughs to restrict the travel of the dice.

Other and further object will become apparent from the following description and the drawings.

Figure 1:
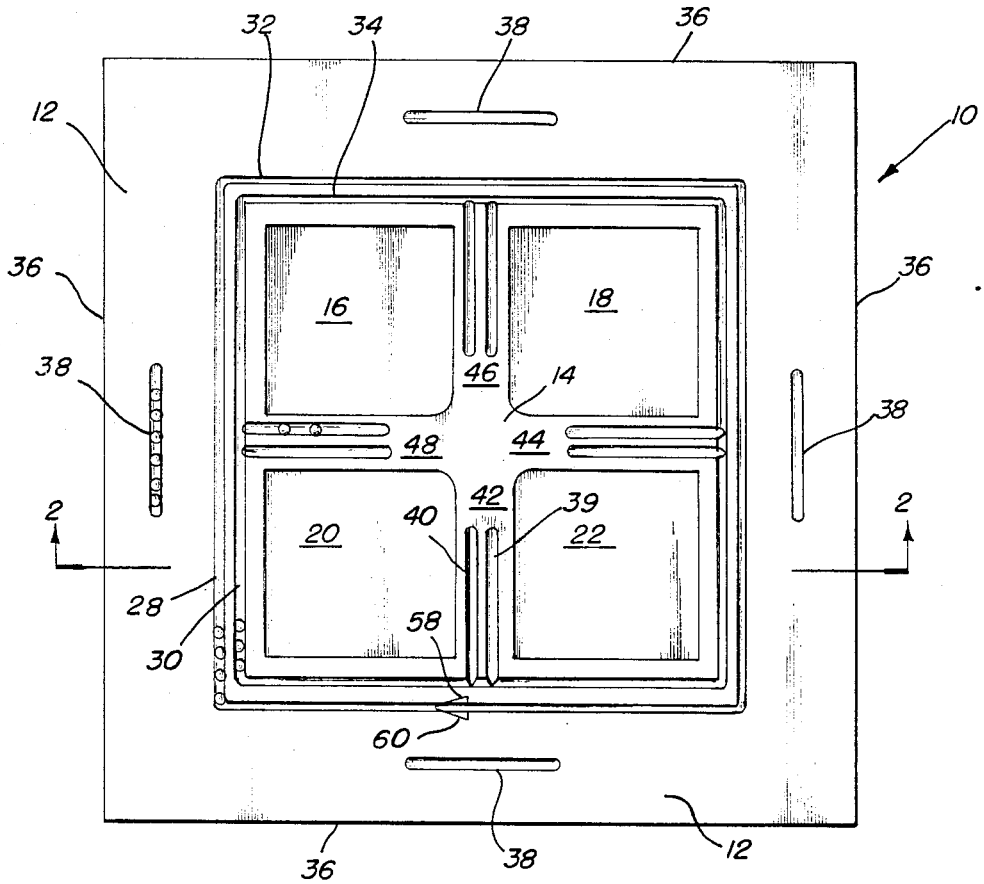
FIG. 1 is a plan view of a game board of the present invention.
Figure 2:
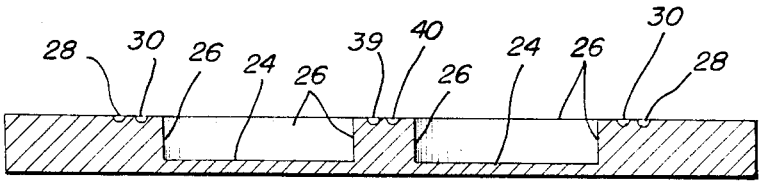
FIG. 2 is a cross sectional view taken along the line 2—2 of FIG. 1.
Figure 3:
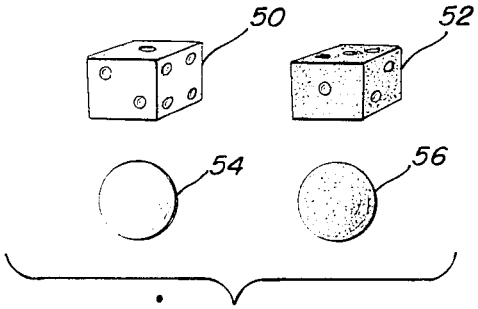
FIG. 3 is a perspective view of the typical dice and marbles used with the game board of this invention.

Referring to the drawings, FIGS. 1 and 3, a game board 10 is shown in FIG. 1, which is herein disclosed as being constructed with a raised playing surface and troughs.

The game board may be constructed of molded plastic, stamped metal, or built up from wood, fibreboard, etc.

The game board 10 has a raised playing area defined by a pheripheral area 12 and a cross-shaped area 14. Defined by the peripheral area 12 and the spaces between the cross-shaped area 14 are four quadrant troughs 16, 18, 20 and 22. These quadrant troughs are depressions in the game board which can vary in depth from game board to game board, depending upon the available materials. Each trough has a bottom 24, and four side walls 26. Obviously, the deeper the trough, the easier to contain the toss dice within the trough, which helps to speed up the game. The raised playing area 12 has a plurality of parallel hemispherical depressions 28 and 30, forming a continuous double track 32 and 34. The continuous double track 32 and 34 allows up to four players to move their game pieces around the double track 32 and 34 in a race to see who finishes first. Between the peripheral area 12, with the continuous double track 32 and 34, and the edges 36 of the game board 10 are storage hemispherical depressions 38 to hold each player's game pieces. The storage depressions 38, called "home," a center along each rectangular side of the game board.

Turning to the raised cross-shaped playing area 14, there are rows of hemispherical depressions 39 and 40 connecting to continuous double tracks 32 and 34. There are four such rows 39 and 40, which are called "winner's row" 42, 44, 46 and 48, respectively. Each "winner's row" is directly in front of that player's "home" position.

Each player has his own dice 50 and 52 and playing pieces or marbles 54 and 56. A player's marbles 54 and 56 are divided into four of one color and four of another, say four blue marbles 54 and four light blue marbles 56. Likewise, one die 50 would be blue and the other 52 light blue. Each player would have a like number of marbles of a color and a similar number of a shade lighter. Also, the player would have dies 50 and 52 to match.

In playing, the marbles are placed in each player's "home" position 38 on to the double track 32 and 34. Since only one die 50 or 52 corresponds to a particular color group only one marble 54 or 56 can move out of the "home" position on a given turn. In other words a marble of a particular color can move the number rolled by the same color die. For example, if a player of red/-pink marblers rolls a red 1 or 4 and a pink 3, he then places his red marble on the start position 58. The player must wait until his or her next turn to roll his pink die again. Both dies 50 and 52 are rolled at the same time. The pink marble cannot move to its start positions 60 until a 1 or 4 is rolled, however the red marble in the start position 58 can be moved the number thrown, should that number be a six, then the red marble is moved six spaces to the left. If the space is occupied by another player's marble, it is sent home to its "home" position and the red marble occupies that space, and the red player takes an extra turn with the red die as a bonus for sending the player's marble back home. The marbles 54 and 56 are moved around the continuous double track 32 and 34 until all of a player's marbles are in the "Winnner's" row 42, 44, 46 or 48, respectively. Each time a player rolls a 4, the number can be doubled to 8 or to move a marble to the starting position 58 or 60. When a marble on the outside track 32 is about to enter the "Winner's" row, the marble jumps over the inside track 34 to enter the "Winner's" row. The marbles entering the "Winner's row must move the number showing on the die, so that all eight spaces are filled. All eight marbles must be in the "Winner's" row to win.

The game can be played by two to four players. It can be played as teams, or as single fours using only four marbles and a matching color die on a single continuous track.

The game board 10 may be multi-colored using the colors of the marbles to indicate a player's "home" position, start position and "Winner's" row.

While one skilled in the art may realize other embodiments of the invention, it should be pointed out that one should look to the drawings and specification for a complete understanding of the invention.

We claim:

1. A game board and game pieces for a game of skill and chance utilizing dice, comprising; A raised game board playing surface including a peripheral, rectangular double track means and a cross-shaped inner track means intersecting said double track midway between each right angle of said rectangular double track means, trough means defined by quadrants between said cross-shaped inner track means and said peripheral rectangular double track means, thereby forming four such trough means; a "home" position means outside of said peripheral rectangular double track means midway between each right angle of said rectangular double track means, colored game pieces and matching colored dice for playing a game, said trough means has side walls for containing tossed dice, said game board has four playing sides with each playing side having said home position means midway of said side and where each playing side has its trough means to the right of said cross-shaped inner track means, each trough means having a matching color to said game pieces and dice which correpsond to said playing side, said colored game pieces includes equal numbers of pieces of a first color and of a ligher shade of the same color, said dice include one die of said first color and another die of said lighter shade of the same color, there being four such different first colors and four such matching lighter shades of the same colors.

2. A game board and game pieces as in claim 1 wherein said game pieces are marbles.

* * * * *